US008800174B2

(12) United States Patent
Banach et al.

(10) Patent No.: US 8,800,174 B2
(45) Date of Patent: Aug. 12, 2014

(54) SHOE SOLES FOR ENHANCING GRIPPING WITH A SMOOTH HARD SURFACE

(75) Inventors: Timothy Edward Banach, Scotia, NY (US); Lucas James Tucker, Waterford, NY (US); Mark French, Larchmont, NY (US)

(73) Assignee: Mission Product Holdings, Inc., New York, NY (US)

( * ) Notice: Subject to any disclaimer, the term of this patent is extended or adjusted under 35 U.S.C. 154(b) by 211 days.

(21) Appl. No.: 13/178,778

(22) Filed: Jul. 8, 2011

(65) Prior Publication Data

US 2012/0066938 A1 Mar. 22, 2012

Related U.S. Application Data

(60) Provisional application No. 61/363,719, filed on Jul. 13, 2010.

(51) Int. Cl.

| | |
|---|---|
| ***A43C 15/00*** | (2006.01) |
| ***A43B 5/00*** | (2006.01) |
| ***A43B 13/12*** | (2006.01) |
| ***A43B 13/22*** | (2006.01) |

(52) U.S. Cl.
USPC ..... 36/59 B; 36/32 R; 36/134; 36/15; 36/59 A; 36/59 C

(58) Field of Classification Search
USPC ..... 36/32 R, 15, 59 A, 59 B, 59 C, 2.6, 36 R, 36/115, 134, 67 D
See application file for complete search history.

(56) References Cited

U.S. PATENT DOCUMENTS

| | | | | | |
|---|---|---|---|---|---|
| 1,072,794 | A * | 9/1913 | Tradesoo | 36/59 R |
| 2,987,420 | A * | 6/1961 | Bemmels et al. | 428/355 AK |
| 5,564,201 | A * | 10/1996 | O'Connell | 36/3 R |
| 5,822,890 | A * | 10/1998 | Beitel et al. | 36/134 |
| 5,906,059 | A * | 5/1999 | Singer et al. | 36/134 |
| 5,996,260 | A * | 12/1999 | MacNeill | 36/134 |
| 6,046,280 | A * | 4/2000 | Datta et al. | 525/331.8 |
| 6,338,208 | B1 * | 1/2002 | Waterbury | 36/134 |
| 7,165,344 | B2 * | 1/2007 | Blackwell | 36/134 |
| 7,682,575 | B2 * | 3/2010 | Hurwitz et al. | 422/123 |
| 2001/0011429 | A1 * | 8/2001 | Peabody | 36/134 |
| 2005/0252043 | A1 * | 11/2005 | Blackwell | 36/134 |
| 2007/0277399 | A1 * | 12/2007 | Dow et al. | 36/134 |
| 2010/0107450 | A1 * | 5/2010 | Locke et al. | 36/134 |
| 2010/0139128 | A1 * | 6/2010 | Wilson, III | 36/32 R |

* cited by examiner

*Primary Examiner* — Khoa Huynh
*Assistant Examiner* — Katharine Gracz
(74) *Attorney, Agent, or Firm* — Myron Greenspan; Lackenbach Siegel LLP

(57) ABSTRACT

Shoe soles with and without removable/replaceable gripping pods for athletic or sport shoes are provided with enhanced traction. The sole portions or gripping pods may be provided with a supply of a substance that exhibits a tackiness for enhancing friction between the shoe sole and the any hard floor. The tackiness-enhancing substance may be time-released or discharged from within the shoe sole onto the lower surface(s) of the sole that make(s) contact with the smooth hard playing surface or may be in response to compression or shear forces acting on the sole during play to prolong the tacky properties and reduce slippage. A visual indicator may be provided for notifying the player that it is time to replace the worn or used pod and insert a fresh pod or insert into the pod(s) to maintain high levels of gripping.

23 Claims, 11 Drawing Sheets

SHOE SOLES FOR ENHANCING GRIPPING WITH A SMOOTH HARD SURFACE

CROSS REFERENCE TO RELATED APPLICATION

This application is related to Provisional Patent application Ser. No. 61/363,719 filed on Jul. 13, 2010.

BACKGROUND OF THE INVENTION

1. Field of the Invention

The invention generally relates to athletic shoes and, more specifically, to shoe soles for enhancing gripping with a smooth hard surface.

2. Description of the Prior Art

In the quest to provide and maintain adequate traction, numerous efforts have been made to enhance the coefficient friction between a shoe sole and a surface on which the shoe is used. For example, in U.S. Pat. No. 4,555,765 a sport shoe sole is described that possesses a high coefficient of friction along certain portions of the sole while other portions of the sole are formed of a compressible and resilient material that is harder than the material of the rest of the sole.

Efforts have also been made to coordinate the design of the sole with the anatomic variations of the foot. Thus, in U.S. Pat. No. 7,101,604 a sole is described as having a natural grip corresponding to the ergonomic gripping or traction pattern based on the natural foot print of the foot. The sole design, therefore, is provided with major and minor projections that correspond to the various high or low points of the human foot, presumably corresponding to the points of maximum pressure or compression. However, the sole is formed of an elastic deformable material commonly used for athletic shoes, including rubber, PVC and any suitable synthetic elastic substance. The sole is also described as having a base and projections, recesses and ridges as well as possibly including two or more layers in forming the various contours in a sole. Enhanced gripping is based primarily on the configurations of the various projections, ridges, etc.

Athletic shoes have also been proposed that have interchangeable soles. However, these are primarily intended to replace soles that wear out to avoid the expenses of purchasing new shoes. Such an athletic shoe with an interchangeable sole is described in U.S. Pat. No. 5,317,822. Another shoe having a replaceable sole is described in U.S. Pat. No. 7,331,123, the shoe having a thin cavity in the bottom surface of the sole that releasably receives a thin sole plate. The sidewall of the cavity includes flaps that extend into the cavity and the sole plate has depressions that receive the flaps when the sole plate is placed in the cavity and pushed past the flaps. The design is intended to allow the individuals to select their own personal preferences within a wide range of styles and colors of foot wear.

It has also been proposed to interchange gripping elements on sport shoes. In most of the proposed designs the gripping elements that are designed to be replaced are spikes of the type used on golf, soccer or other sport shoes. For example, in U.S. Pat. No. 3,812,605 a sport shoe is described with interchangeable gripping elements in the form of spikes that are releasably fastened in recesses in a sole by locking pins extending through the soles in the base portions of such spikes. The spikes are rotated a predetermined angle from the original positions to lock or unlock the spikes—similar to a bayonet type connection. A non-slip sandal with fully replaceable parts is described in U.S. Pat. No. 5,836,090 in which the replaceable studs can be attached and disconnected from threaded opening in the sole so a user can select a profile of the spikes, including a short stud, a medium sized steel spike and a long steel spike.

However, none of the known prior art discloses a shoe sole with replaceable gripping pods or shoe soles specifically for enhancing the gripping properties of sport shoes intended to be used on smooth hard floor surfaces such as basketball, volleyball and the like courts.

SUMMARY OF THE INVENTION

Accordingly, it is an object of the present invention to provide a shoe sole or gripping pods, intended to be used on shoe soles that enhance gripping properties and traction on sport shoes used on smooth hard floor courts by emitting, releasing or discharging a tackiness-enhancing material from the sole and/or pods to the surface(s) of the portion(s) of the shoe sole that make contact with the smooth hard surface.

It is another object of the present invention to provide shoe sole or gripping pods as in the previous object that are impregnated with a substance that exhibits tacky properties and neutralizes the effect of dust and other debris on hard floor courts.

It is still another object of the present invention to provide gripping pods as in the previous objects that change colors to provide a visual indication as to when the pods need to be replaced in order to ensure continued reliable gripping and traction.

It is yet another object of the present invention to provide replaceable gripping pods with enhanced gripping properties to increase the traction of a shoe sole and sports shoes using the same on smooth hard surfaces.

It is a further object of the present invention to provide shoe sole or gripping pods as in the previous objects that are simple in construction and economical to manufacture.

It is still a further object of the present invention to provide a shoe sole that can accept or receive gripping pods of the type under discussion.

It is a further object of the present invention to provide a shoe sole and gripping pods on shoe soles that exhibit a tackiness and avoid the need for moistening the shoe soles and physically removing dust and debris in order to maintain traction.

It is an additional object of the present invention to provide shoe soles and gripping pods of the type under discussion that relieve players from the need to take any steps during play for cleaning the bottoms of their shoe soles or in any way interrupting the game to do so in order to maintain reliable traction.

In order to achieve the above objects, as well as others that will become evident hereinafter, the present invention is for shoe soles and disposable/replaceable gripping pods or inserts that are removably attachable to the soles of athletic or sport shoes, such as sneakers. The grip enhanced portion(s) of the shoe soles, or the gripping pods attached to the shoe soles are preferably placed at strategic points of the soles where grip and traction are critical. The shoe soles or portions thereof, or gripping pods are either impregnated or provided with an interior supply of an adhesive-like substance that exhibits a tackiness for enhancing friction between the shoe sole and a smooth hard floor surface by emitting, releasing or discharging the substance onto the surface(s) of the shoe sole that make(s) contact with the smooth hard floor surface. A visual indicator may be provided for notifying the player that it is time to insert a fresh pod or replenish the supply to maintain high levels of gripping. This is achieved, for example, by providing multiple layers on a hard plastic surface, with an outer layer providing tacky properties while an inner colored layer becomes exposed when the tacky substance layer is depleted after extended play. Also, the pods themselves can be made from a hard plastic of a certain color that becomes visible when a single coating or layer of the tacky-producing substance is depleted. Alternatively, pods can include dye containing microcapsules for dispensing tackiness-enhancing material, whereby the pods maintain a predetermined color of the dye until said microcapsules are depicted of tackiness-enhancing material resulting in a change of color indicating that the pods need to be replaced or replenished. Any suitable attachment mechanisms can be used for connecting the pods to the shoe soles, such as bayonet or threaded connectors.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENTS

Figure 1:
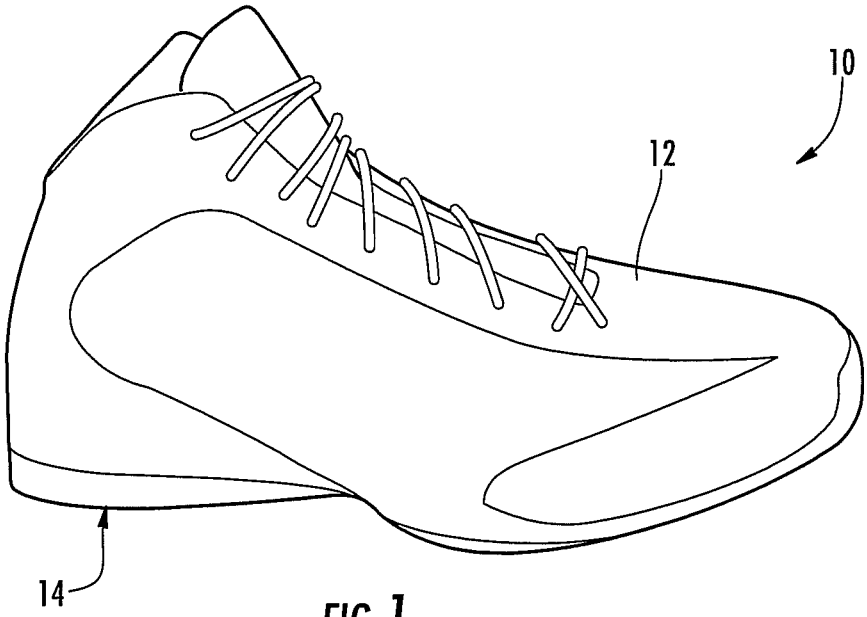
FIG. 1 is a side elevational view of a shoe, in a form of a sneaker, in accordance with the present invention.
Figure 2:
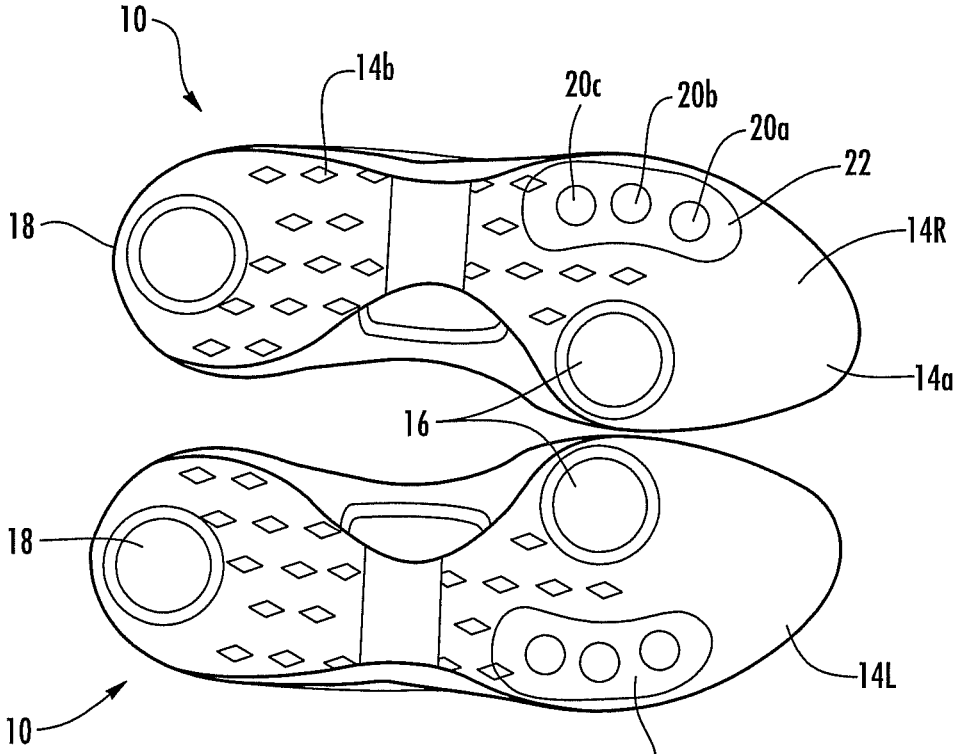
FIG. 2 is a bottom plan view of a pair sneakers of the type shown in FIG. 1, showing the nature and locations of the gripping pods in accordance with the invention.

Referring now specifically to the Figures, in which the identical or similar parts are designated by the same numeral numbers throughout, and first referring to FIGS. 1 and 2, the athletic or sport shoe 10 is provided with an upper 12. The nature of the upper 12 is not critical and the upper will be selected to conform to the sport or activity involved. The nature or construction of the upper is not relevant for the purposes of the invention.

The shoe 10 also has a sole 14. In FIG. 2 a pair of shoes, with right and left soles 14R and 14L, are shown, these being mirror images of each other. Accordingly, the description of one sole applies equally to the other sole. While the specific sport is irrelevant, the specific configurations of the soles may differ slightly for different sport activities. In one embodiment of the invention a pair of sports sneakers have replaceable inserts or "pods" that are infused or imbedded with a chemical agent or compound that provides or enhances the gripping properties of the soles and improves traction to the player on a smooth hard surface court.

An important feature for most of the embodiments in accordance with the present invention is that an entire shoe sole or selected portions thereof, or replaceable pods attached to the shoe sole, are impregnated or otherwise provided with a supply of tackiness-enhancing substance or composition that is emitted, discharged or released during use of the shoes to the surfaces thereof that make contact with the smooth hard surface to prolong desired tackiness properties and minimize slippage on the smooth hard surface.

Generally, the sole 14 may consist of a main portion 14*a* that forms a base. The base 14*a* may include patterned regions 14*b* that include recesses, ridges and other surface textures that are frequently employed to provide or increase traction. However, one feature of the invention is the provision of at least one but preferably a plurality of regions of the sole or gripping pods attached to the sole that exhibit a tackiness or increased frictional properties and that can be replaced as needed to maintain or improve traction on a smooth hard surface. In the illustrated embodiment, in FIG. 2, large diameter pods 16 are provided generally at the location of the ball of the foot and comparable large diameter pods 18 are located at the heel of the foot, these being common high pressure points.

A plurality of pods 20 along the outside edge of the foot, generally along a direction parallel to the metacarpal bones in the foot and substantially laterally across the positions or location of the large pods 16. In the embodiment illustrated, three such smaller pods 20*a*-20*c* are arranged within a somewhat arcuate land or strip 22 that generally conforms to the outside edge of the foot. The three indicated points, the ball, heel and outside edge of the foot are three points of high horizontal or shear friction where friction and grip are critical.

In accordance with one feature of the invention, the pods 16, 18, 20 are easily and conveniently replaceable so that these can be individually removed from the sole 14 of the shoe and new pods inserted as may be needed once the active material in these pods becomes depleted.

Figure 3:
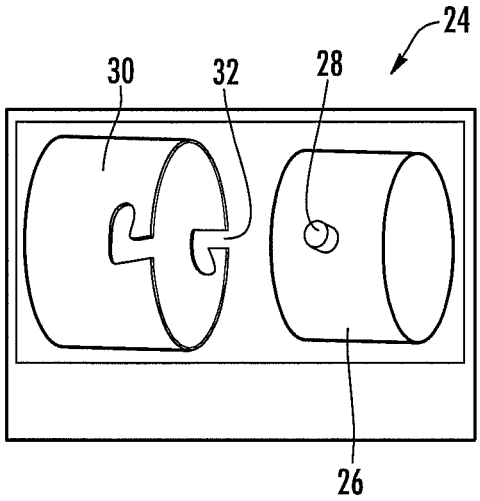
FIG. 3 is an exploded diagrammatic view of a bayonet connector of the type that can be used for attaching and detaching the gripping pods to and from the shoe soles.
Figure 4:
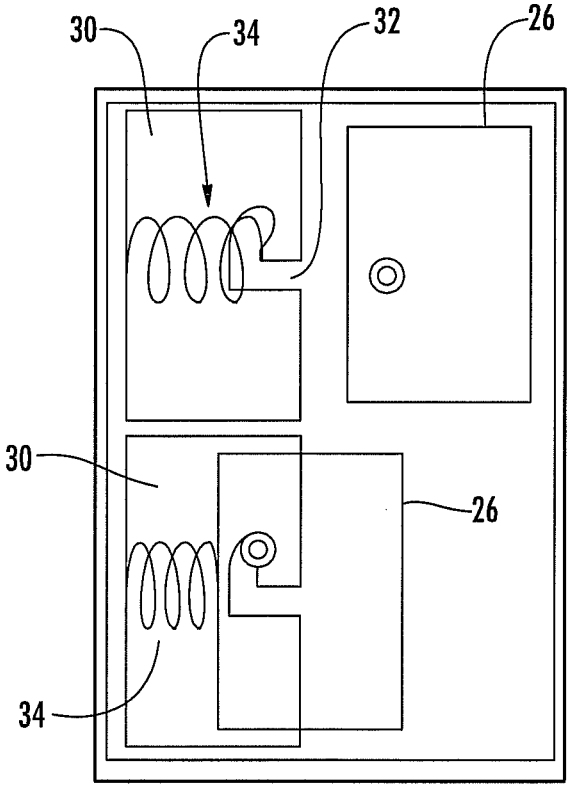
FIG. 4 are side-diagrammatic views illustrating the manner in which the bayonet connector shown in FIG. 3 can be used to retain and release the pods from the shoe sole.

Referring to FIGS. 3 and 4, a simple means for connecting the pods to the sole of the shoe is schematically illustrated, showing a bayonet connector 24. Bayonet connectors are well known and are used in many applications, including light bulbs, RF cables, etc. and generally include a male cylindrical member provided with two radially outwardly directed diametrically opposite pins 28 and a female portion 30 for receiving the male part 26 and provided with diametrically opposite L-shaped slots, the initial part of the slots being generally being parallel to the axial direction of the connector while the inner portions of the slots are generally circumferential but slightly outwardly directed so as to define an incline as shown. Inside the female connector there is provided some biasing member, such as helical spring 34 that urges the male part radially outwardly when inserted. By inserting the male part 26 so that the pins 28 become aligned with the slots 32 the male part of the connector may be rotated about its axis to enter the inner part of L-shaped slots. The springs 24 urge the male part 26 outwardly to retain the pins 28 within the slots. The pods may be provided at the axial end of either the male or female parts 26, 30. Additionally, numerous other connecting devices may be used, including screw treads or any other connector that is easy and convenient to use. Since the smaller pods 20*a*-20*c* might be more difficult to manipulate such smaller pods may be integrally formed with the land or strip 22 which itself can be removed and replaced with all of the smaller pods 20. The land or strip 22 may be held in place by any known or suitable means, including a tacky substance, hook and loop fasteners such as (VELCRO®) or the like.

An important feature of the invention is the provision of supply means for impregnating or infusing selected portions of the sole or the pods 16, 18 and 20 with a suitable tacking-enhancing composition or substance that forms a renewable coating that can be effective for an extended period of time and create and maintain a tacky surface on the outer surface of the shoe sale that increases the coefficient of friction and, therefore, the traction between the pods and a smooth hard floor. Any substance that provides these properties can be used for this purpose in conjunction with the present invention. Examples of such material are described in co-pending application Ser. No. 13/162,026, filed on Jun. 16, 2011 and such application and disclosure therein is incorporated into this application as if fully set forth herein. The pods, therefore, are not simply infused with any liquid, such as water, to essentially wash the undersurface of the sole, which would in all likelihood increase rather than decrease traction and provide a slippery surface on the sole. Instead, the pods are infused with a composition that provides tackiness and enhanced grip. Such composition, as suggested, can be anything that increases grip to a smooth bud court surface.

Figure 5:
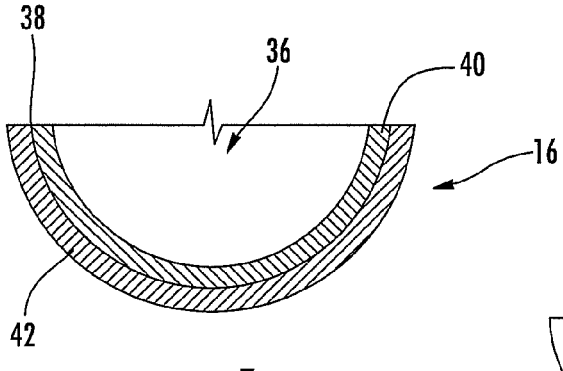
FIG. 5 is a fragmented cross-sectional view of the exterior surface of a gripping pod to illustrate an embodiment for providing a visual indication of one of the active substance that enhances tackiness and traction that has been depleted and the pod needs to be replaced.

While the specific construction of the pods is not critical and numerous constructions can be used to effectuate the objectives and advantages of the present invention, FIG. 5 illustrates one construction that can be used. Thus, the pod 16 is formed of a generally rigid or semi-rigid member 36 that exhibits a curved surface 38. A first layer 40 is applied to the surface 38 and a second layer 42 is applied to the first layer. The second layer 42 comprises a coating of a tacky producing material or a layer of material that is impregnated with the tacky producing substance that is released in any desired way. Once the tacky producing substance has been depleted or the layer 42 has been removed through extended use and wear, this exposes the color-bearing layer 38 to provide a visual indication to the user that the pod is no longer effective for its intended purpose and a new pod needs to be inserted or the existing pod replenished by impregnating or infusing it with the depleted substance, if the part is capable of being replenished. It is also possible to make the rigid member 36 have a desired color indicating that the layer 42 has been depleted, in which case only a single layer 42 may need to be used and the color bearing layer 38 may be omitted. As soon as the layer 42 wears away, this would expose the rigid member 36 to provide a comparable color indicating a need to replace or replenish the pod. The pods may also include dye containing microcapsules for dispensing tackiness-enhancing material, whereby the pods maintain a predetermined color of the dye until the microcapsules are depleted of tackiness-enhancing material resulting in a change of color indicating that the pods need to be replaced or replenished.

The tackiness producing substance is a chemical solution or composition, as opposed to simply fluid for washing the bottom of the shoe sole to physically remove dust, lint and other particulates, the tacky producing substance is employed at the main contact points as indicated. That increases the surface adhesion between the shoe and a smooth hard floor such as basketball court or the like.

Figure 5A:
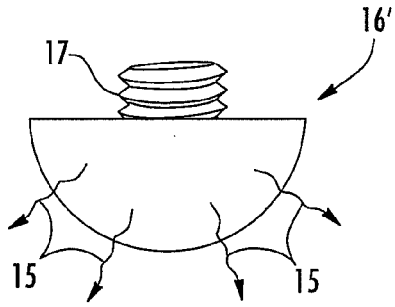
FIG. 5*a* is a side elevational view of another embodiment of a pod in accordance with the present invention.

FIG. 5*a* is another example of a replaceable pod 16' that is generally hemispherical in shape and formed of a generally solid material such as rubber infused with a tackiness-enhancing composition that can leak out, leach or "bloom" in a timed-release or in response to compression and/or shear forces applied to the pod, as suggested by arrows 15. This pod 16' is also provided with a threaded screw 17 that can mate with a threaded socket in the shoe sole (not shown).

Figure 5B:
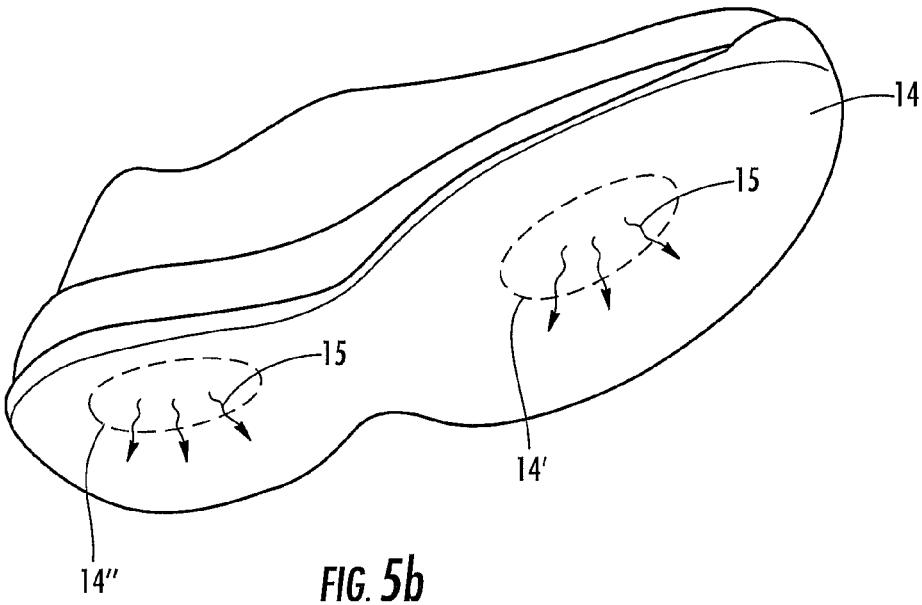
FIG. 5*b* is a perspective view of a shoe with a sole in accordance with the present invention.

FIG. 5*b* illustrates a shoe sole 14 embodying the invention in which no removable pods are used. Instead, either the entire shoe sole or selected portions thereof are impregnated with a tackiness-enhancing composition, such composition being provided at selected locations 14', 14" generally corresponding to one or more high pressure point locations. The tackiness-enhancing composition may be brought to the lower surface, as suggested by arrows at 15, by leaching or "blooming" to provide a gradual release of the composition, preferably in response to pressure or shear forces applied to the sole, in manners to be more fully described below or in a timed release fashion.

While FIGS. 3-5 illustrate generally diagrammatic views of proposed pod constructions that may be used, FIGS. 6-14 illustrate more specific constructions for implementing the invention.

Figure 6:
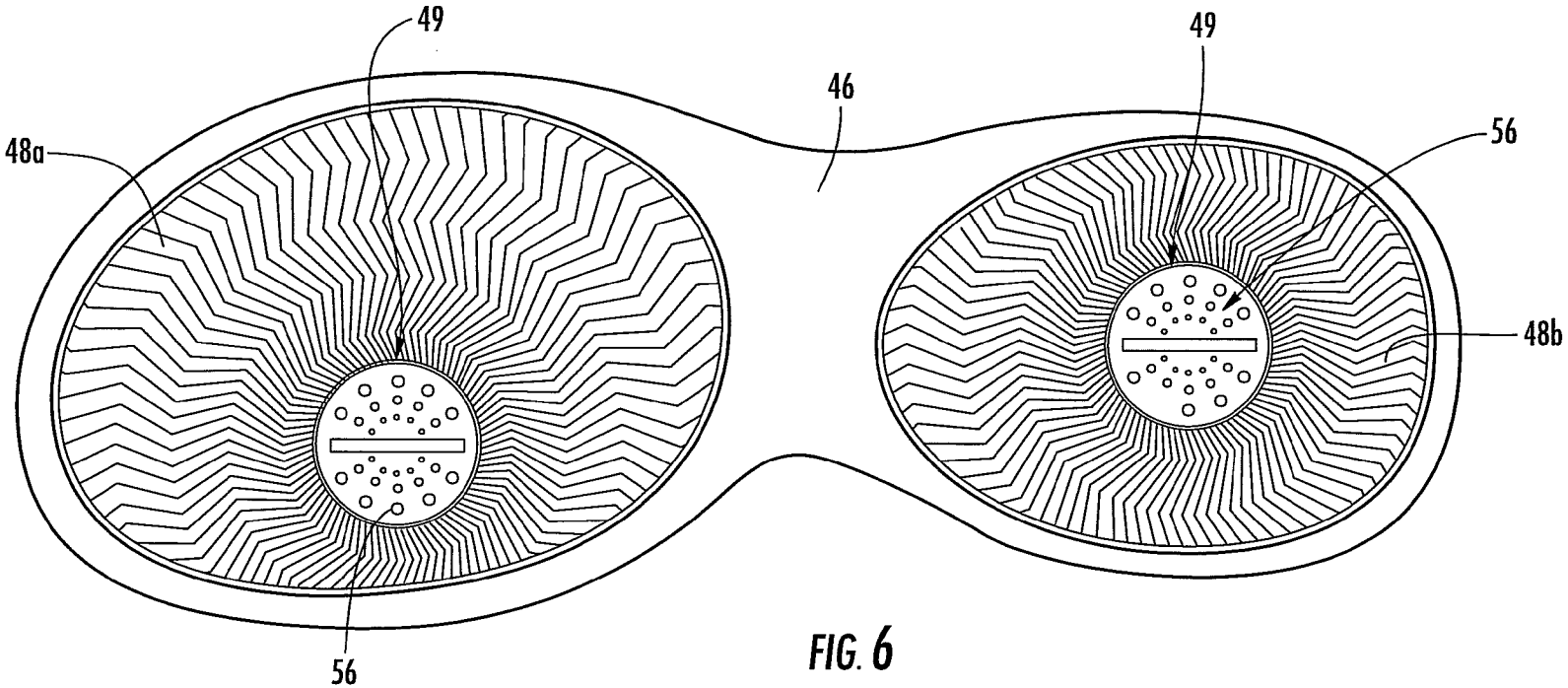
FIG. 6 is a bottom plan view of a shoe sole incorporating two pods in accordance with the present invention each for dispensing tackiness-enhancing material or compound at the fore foot pivot point and center heel locations of the sole.
Figures 7, 7A, 7B:
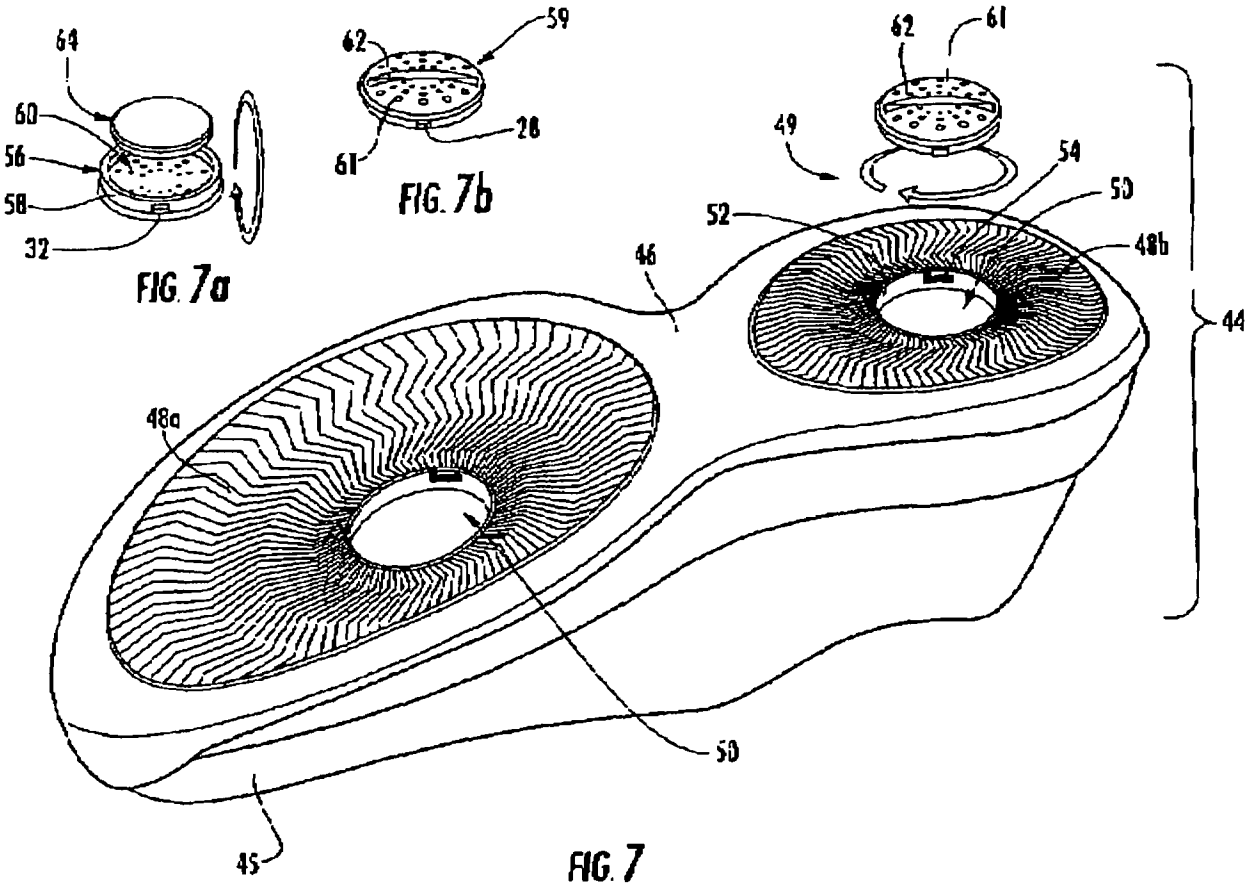
FIG. 7 is a perspective view of the shoe sole shown in FIG. 6, with the pod at the center heel location disassembled to illustrate the manner in which the pod is attached to the shoe sole.
FIG. 7*a* is a perspective view of the underside of a pod of the type shown in FIGS. 6 and 7, with an absorbent reservoir pad spaced from the pod cover.
FIG. 7*b* is a perspective view of the outer cover or wall of a pod of the type shown in FIGS. 6 and 7, illustrating an array of perforations or holes in the top wall and a coin slot to turn the pod wall during attachment and detachment of the pod from the shoe sole.

Referring to FIGS. 6 and 7 a shoe 44 has an upper 45 and a shoe sole 46, the forefoot portion 48*a* and the heel portion 48*b* being formed with an outside design consisting of radial or zig-zag strips emanating from a fore foot pivot point location and from a center heel location as shown. At both pressure points, at the forefoot pivot point and the center heel locations, there is provided a pod 49 that is removably attached to the sole 46. At each of the aforementioned locations there is provided a cavity 50 in the sole 46 formed by a cylindrical wall 52. L-shaped slots 54 are formed on diametrically opposite sides of each cylindrical wall 52 as shown and removable modules 56 are each formed with a cylindrical wall 58 dimensioned to be received within a cavity 50, the cylindrical wall 58 being formed with tabs or pins 32 as shown on diametrically opposite sides and, together with the outer wall 59 forms a compartment or reservoir 60. The outer wall or cover 59 is formed with a plurality of apertures or holes 61 and a diametrical slot 62 dimensioned to be engaged by the edge of a coin to allow the cover module 56 to be rotated about its axis of symmetry. An absorbent reservoir pad or absorbent material 64 is dimensioned to be received within the reservoir or compartment 60 and impregnated with the tackiness-enhancing substance, composition or material. After the absorbent pad or material 64 is received within the reservoir or compartment 60 the module 56 can be aligned with the cavity 50 as shown in FIG. 7 and the module lowered to bring the pins or tabs 28 into alignment with the open end of an L-shaped slot 54. Once received to bring the tab or pin into alignment with the lower or inner portion of the slot, the module can be rotated to lock it in place with the absorbent reservoir pad disposed therein, as described in connection with FIGS. 3 and 4.

Figure 8:
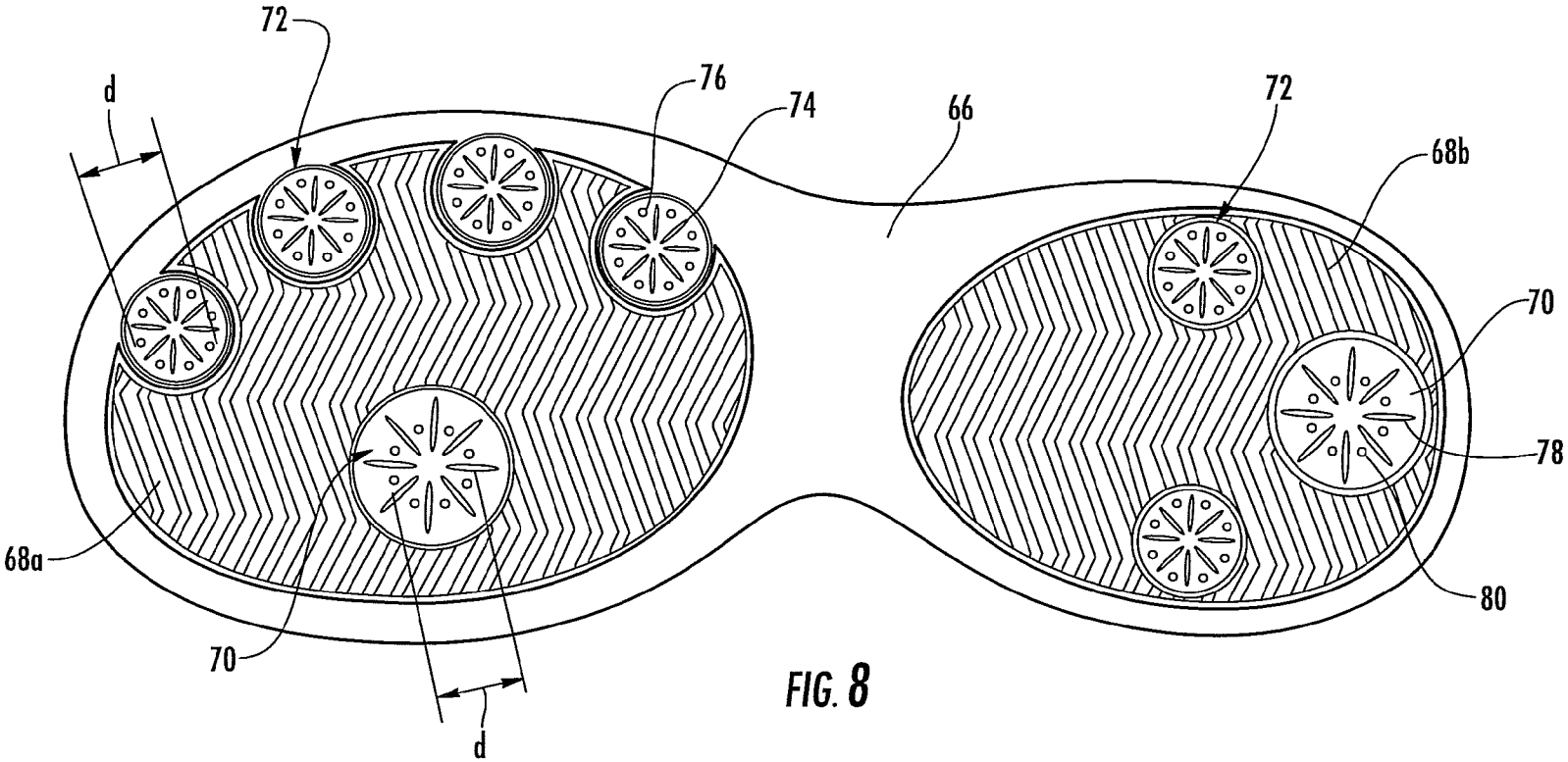
FIG. 8 is a bottom plan view similar to FIG. 6 but showing a different arrangement of pods at selected pressure points of the shoe sole.
Figures 9, 9A, 9B, 9C:
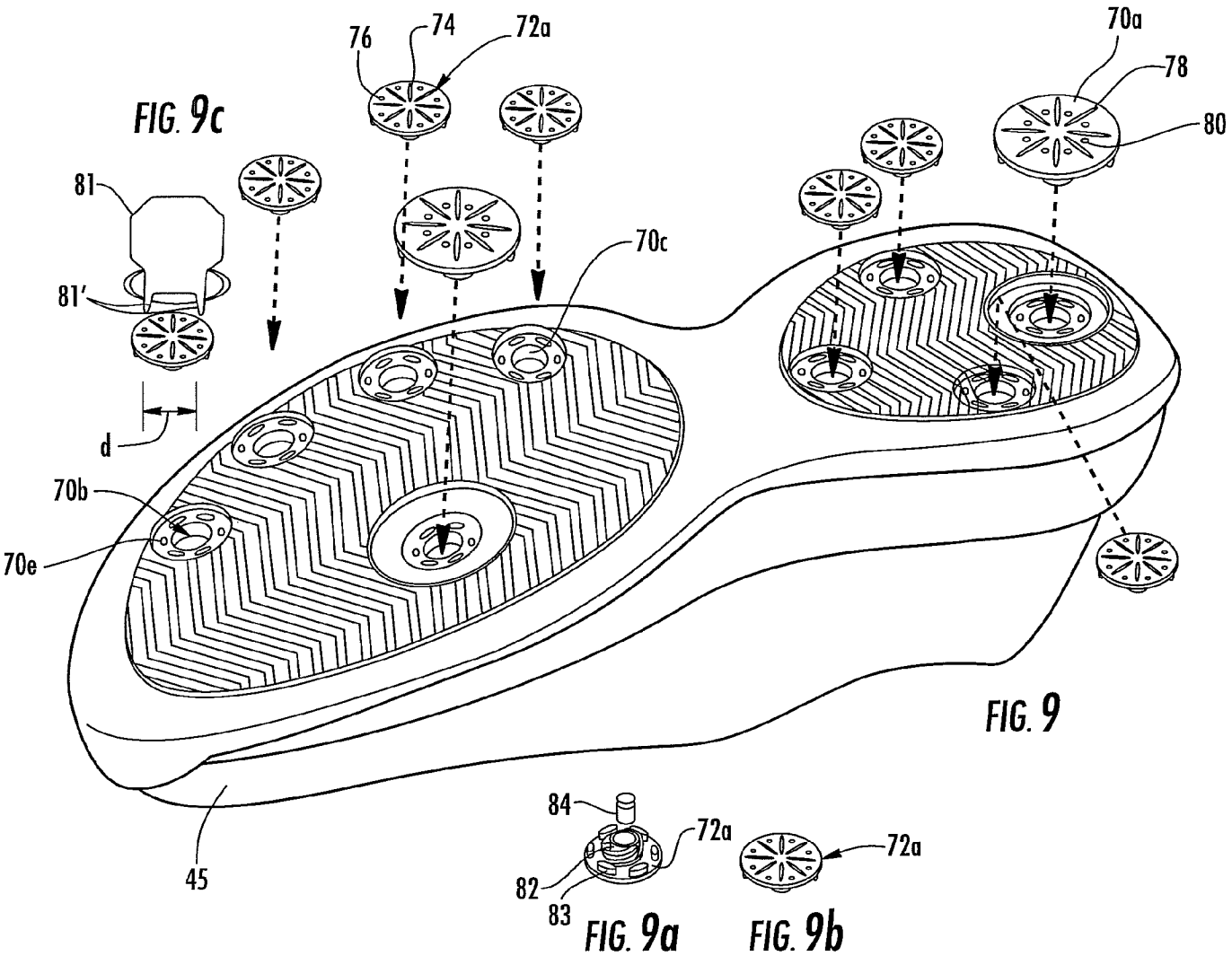
FIG. 9 is an exploded perspective view of a shoe sole similar to the one shown in FIG. 8 to show the pod covers removed from the pod seats or sockets.
FIG. 9*a* is a perspective view of an underside of a pod shown in FIG. 9 and an arrangement for securing a compound releasing element.
FIG. 9*b* is a perspective view of an outer wall or cover one of the pods shown in FIG. 9 for allowing tackiness-enhancing compound to be released through the apertures in the removable modules.
FIG. 9*c* is perspective view of a pod tool including spaced tines dimensioned to engage the apertures or holes in outer surface of the pod covers or walls for facilitating securing to or separating the pods from the shoe sole.

Referring to FIGS. 8-9*b*, another variation of a sole is illustrated in which the forefoot and heel locations 68*a*, 68*b* are formed with an outsole pattern consisting of substantially parallel, side-to-side directed zig-zag ships. Additionally, in addition to the pod 70 located at the forefoot pivot point location as in the previous embodiment, four additional smaller pods 72 are arranged along the outer perimeter of the front portion 68*a* as shown. Two smaller pods 72 are also located to each side of the heel portion 68*b* while a larger pod 70 is provided at the rear of the heel, generally along the center line of the shoe sole. Instead of a radial array of holes as shown in FIGS. 6-7*b*, the smaller pods 72 are provided in the outer wall 72 with radial slots 74 and circumferential apertures or holes 76 between each two radial slots as shown. Similarly, the larger pods 70 are provided in the outer walls 70*a* with longer radial slots 78 between which are provided holes or apertures 80 arranged along a circular path. Preferably, the spacing "d" between diametrically opposite holes 76 of the smaller pods 72 is the same as the spacing "d" between diametrically opposite holes or apertures 80 in the larger pods 70 so that the same pod tool 81 may be used to turn or twist modules 56 to lock or unlock the pods from the shoe sole. Referring to FIG. 9*c*, a pod tool 81 is illustrated in which the spacing between two projecting pins or tines 81' is also equal to "d" so that the same pod tool can be used with any of the smaller or larger pods shown in these Figures.

Figure 10:
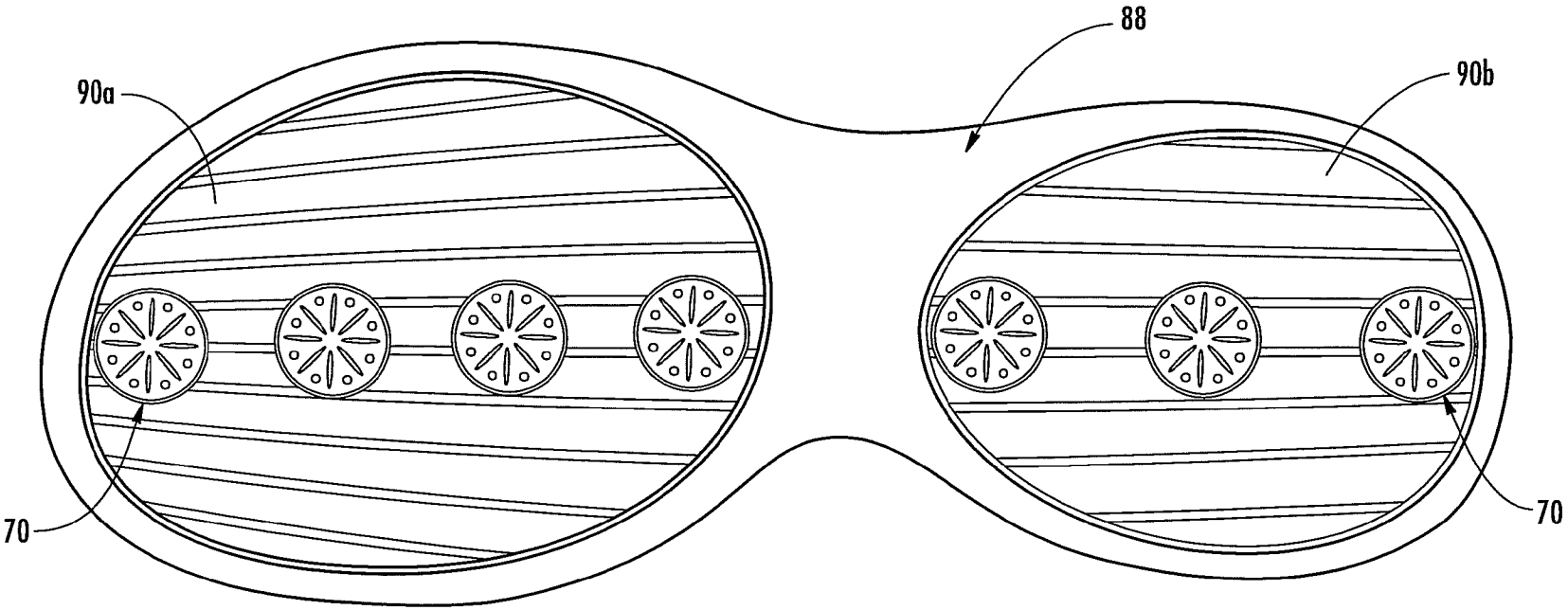
FIG. 10 is a bottom plane view similar to FIGS. 6 and 8, but illustrating a still further embodiment in which the pods are aligned along the center line of a shoe sole.
Figure 11:
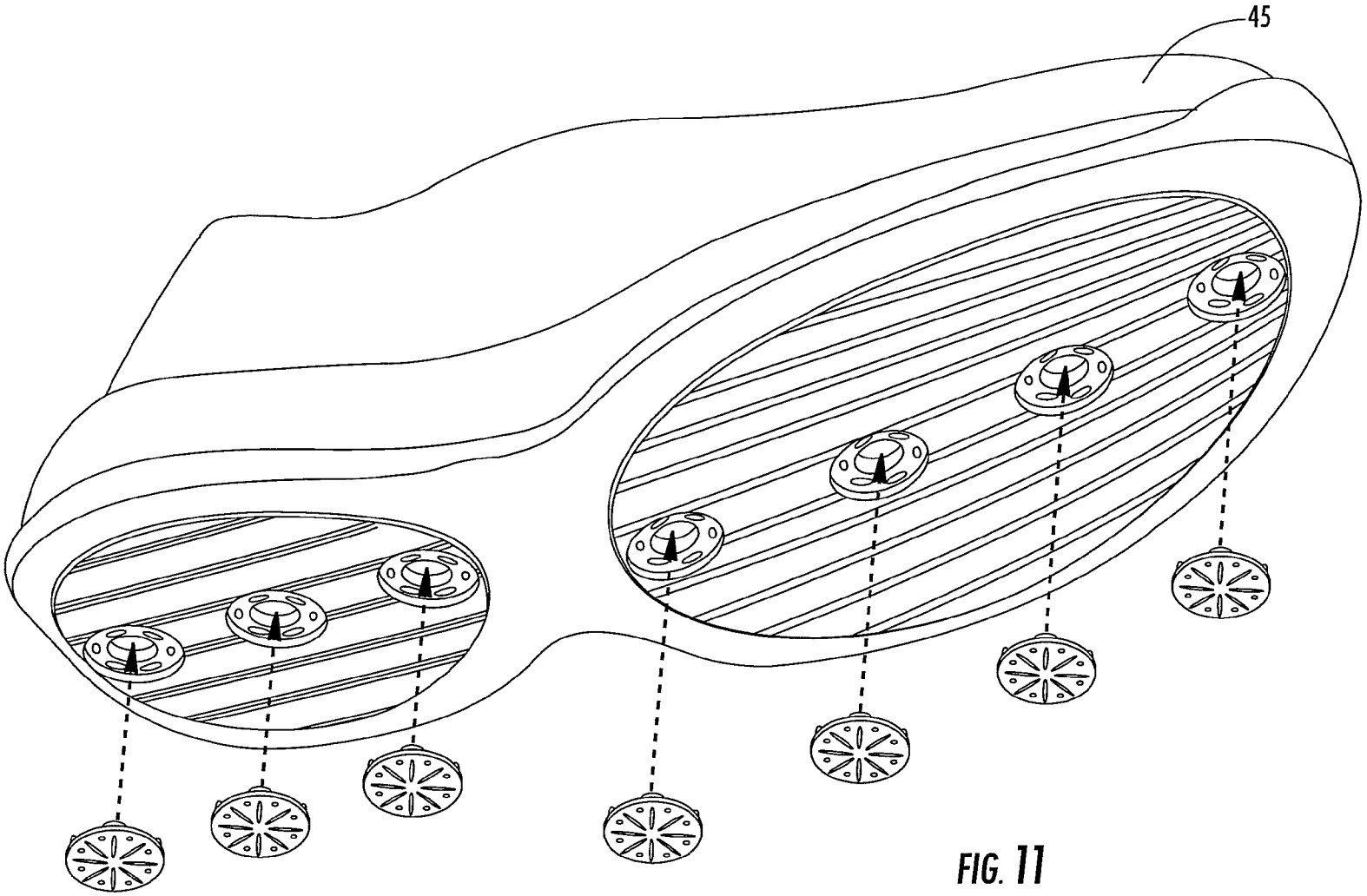
FIG. 11 is a bottom perspective view of the shoe sole shown in FIG. 10, exploded to illustrate the covers or the outer walls of the pods separated from the shoe sole.

Referring to FIG. 9, pods are designed to mate with cavities 70*b* formed by a cylindrical walls 70*c*. Surrounding the cavity 70*b* are a series of openings 70*e*. On the reverse side of the outer walls 72*a* there is provided a centrally located cylindrical wall 82 projecting inwardly as shown and provided with a series of projections 83 dimensioned to be received within the apertures 70*e*. The cylindrical wall 72 forms a cylindrical cavity for receiving a pill or insert 84 infused with a tackiness-enhancing compound. Similarly, a further embodiment is illustrated in FIGS. 10 and 11 in which pods 70 are also provided in a fore foot and heel locations 90*a*, 90*b* shown with pods being aligned generally along the center line of the heel 88.

In each of these embodiments shown in FIGS. 6-11 the absorbent pad or absorbent material 64 and the compound releasing elements or pill 84 is infused with and contains a tackiness-enhancing substance or compound of the type disclosed in U.S. patent application Ser. No. 13/162,026, assigned to the same assignee of the present application. Generally, such a composition may comprise a film former, an adhesive, a tackifier, and a solvent for separating the film former, adhesive and tackifier prior to application to the shoe sole surface and causing same to bond into a tacky film after application and evaporation of the solvent. However, any other suitable material that provides the same or similar functions may also be used, with different degrees of advantage.

Referring for example, to FIGS. 7-11, the removable module 56 (as described on page 14 lines 5-16) and the pods 70, 72 (as described on page 15, lines 1-7 & 11-17) serve a means of supplying tackiness-enhancing substances. The apertures or holes 61, 78 and 80 facilitate the supply, emission, release or discharge of the renewable supply of tackiness-enhancing substance through the holes or apertures to form a renewable coating onto the lower surface of the sole during, use. This insures extended enhanced gripping properties of the shoe ale against a hard surface, such as a smooth basketball court floor.

Figures 12, 13:
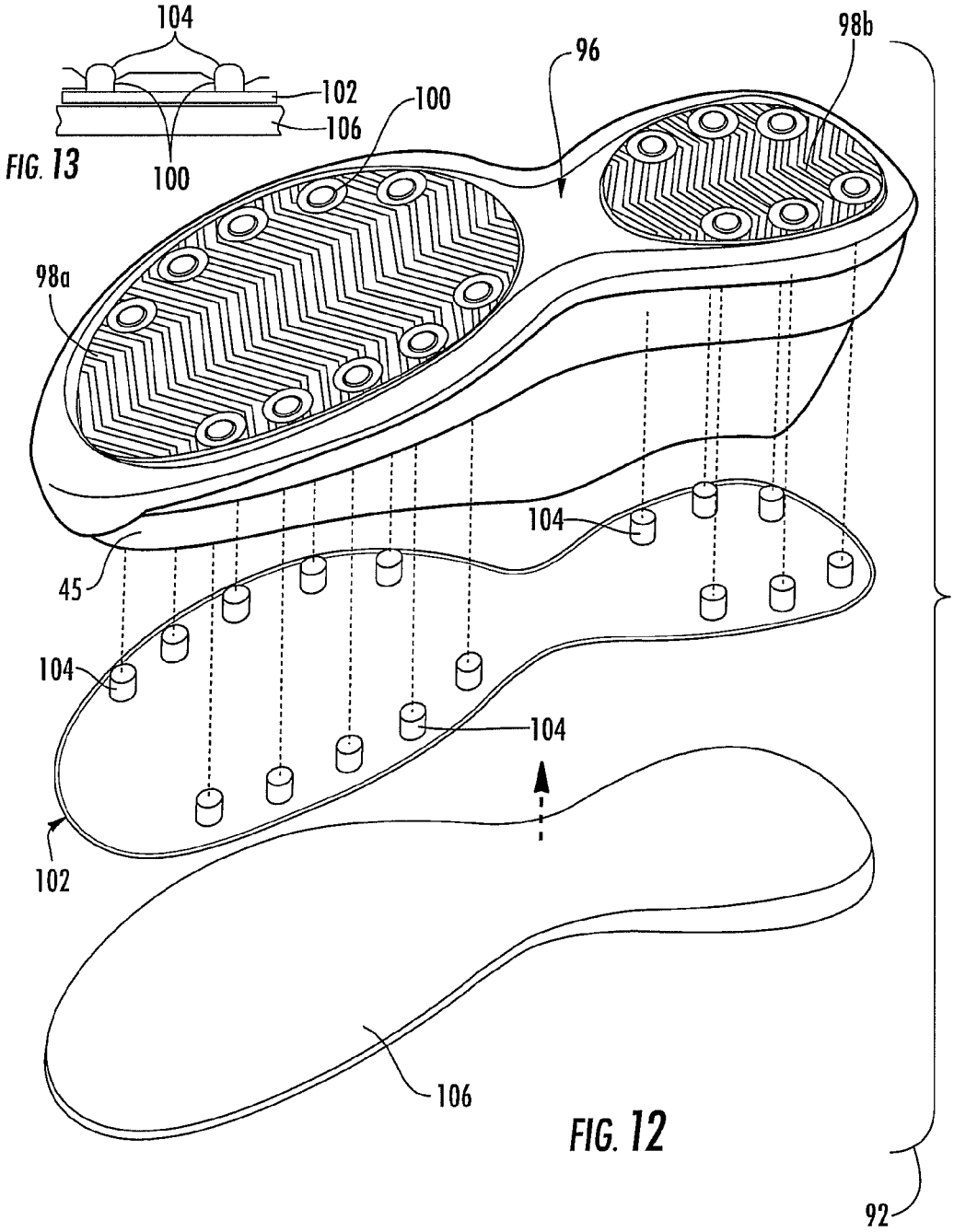
FIG. 12 is an exploded view of a still further embodiment of a shoe sole in the accordance with the present invention in which the shoe sole is provided with apertures or through holes arranged at selected positions on the shoe sole and a vehicle layer for dispensing tackiness-enhancing compound through pillars or projections arranged and dimensioned to be received through the apertures or through holes to extend at least partially beyond the bottom surface of the shoe sole and secured in place between a sock liner and the shoe sole.
FIG. 13 is a partial cross-sectional view through the assembled shoe shown in FIG. 12, showing the various cooperating layers to cause the pillars or projections to extend through the apertures or through holes and maintain the positions of the projections by the sock liner.

Referring to FIG. 12, a shoe 92 is illustrated that has an upper 45 and a shoe sole 96. Forefoot and heel locations 98*a*, 98*b* are formed with a plurality of apertures or through holes 100 through the sole 96, here shown to be arranged along the perimeters of each of the sections 98*a*, 98*b*. A vehicle layer or carrier 102 is formed with a plurality of posts, extensions or projections 104, each of which is generally dimensioned to pass through an associated aperture or through hole 100, as best shown in FIG. 13. The vehicle layer or carrier 102 is secured in place by a sock liner 106 after all of the posts or extensions 104 are passed through the associated holes or apertures 100. The posts 104 are dimensioned to extend slightly beyond or below the lower surface of the shoe sole, as suggested in FIG. 13. Vehicle layer or carrier 102 is maintained in place with a sock liner 106 that prevents the posts or projections 104 from moving out of the apertures. The tendency of the projections to be forced inwardly through the apertures 100 beyond the lower surface of the sole 96, notwithstanding the action of the sock liner 106 to prevent this from occurring, can be reduced or minimized by making the projections or posts and relatively soft so that they are easily compressed to promote the dispensing of the tackiness-enhancing compound only slightly larger than the thickness of the shoe sole.

In the assembled condition, the free ends of the posts, protuberances or projections 104 extend below the surface of the shoe sole and engage or contact the smooth hard playing surface. At least the posts 104, and possibly the vehicle layer or carrier 102, may be infused or impregnated with tackiness-enhancing substance that is dispensed at the free ends thereof when pressure is applied to the shoe sole thereby essentially compressing the posts 104 and urging the fluid like composition to be secreted from the ends of the posts. This refreshes the ends of the posts as well as the bottom or the lower surface of the sole. In this case, the vehicle layer or carrier can serve as an additional reservoir pr supply of tackiness inducing compound that is drawn into the post 104 as the compound is depleted therein.

Figure 14:
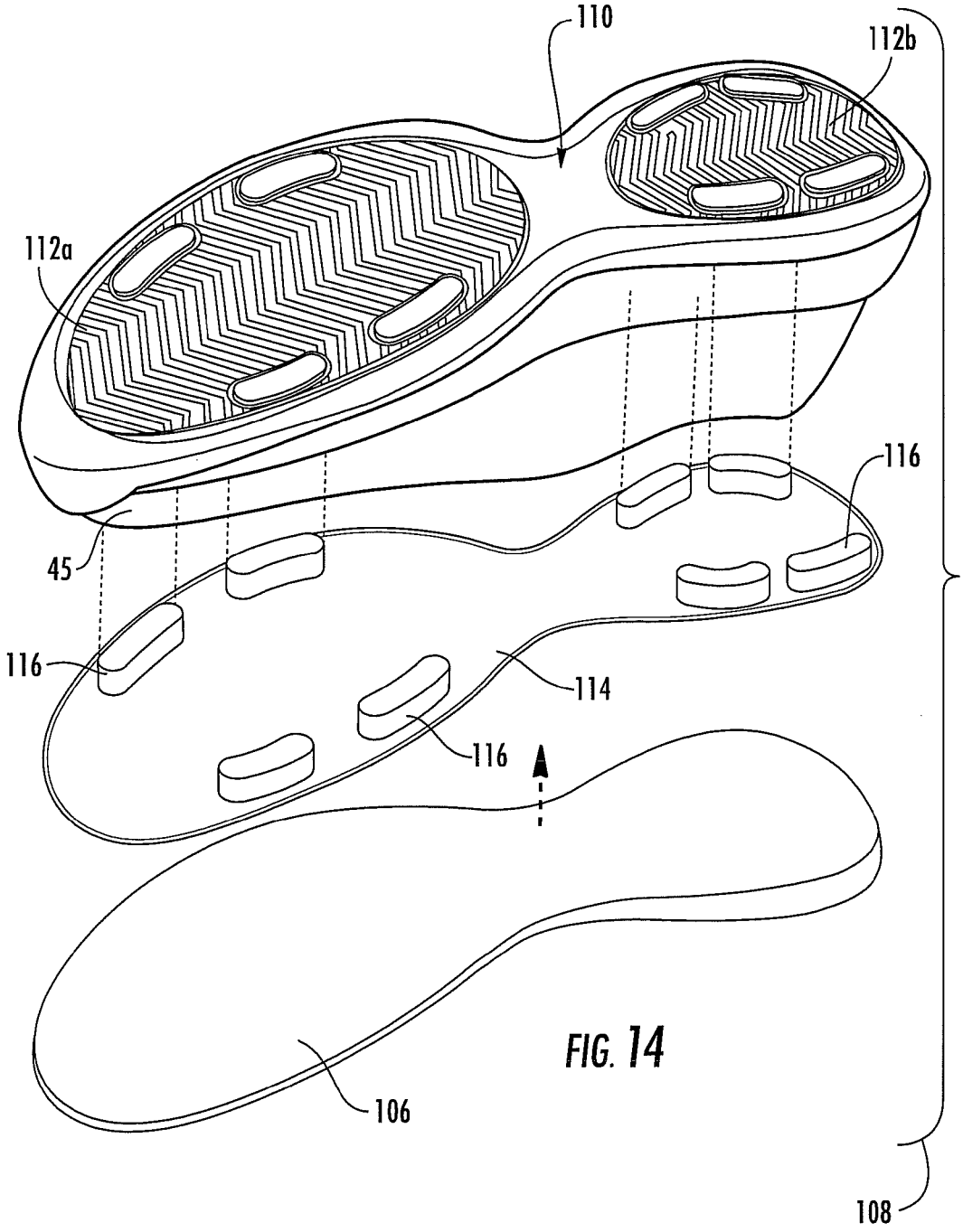
FIG. 14 is similar to FIG. 12 but showing differently configured or shaped apertures or through holes and correspondingly shaped pillars or projections for extending therethrough.

Referring to FIG. 14 another design of a shoe 108 is illustrated similar to the shoe 92 where the apertures or through holes are in a form of elongate aerate slots along the periphery of the shoe sole and the projections or extensions or posts 116 are designed to be received within and extend through apertures or slots. Clearly, any desired shapes can be used for the projections and the corresponding shaped slots or apertures in the soles.

EXAMPLES FOR IMPLEMENTING THE DESCRIBED EMBODIMENTS

I. Wearable Rubber

Manufacture a rubber part that has higher traction than what shoe soles are normally made of which breaks down due to its being softer. Traction is in part due to the relationship of a material's Tg to the actual or ambient temperature T (mathematically that is T−Tg.) As a material nears it's Tg from a solid state it begins to soften due to microscopic portions becoming liquid-like. Thus having a material partially soften would be advantageous. Potential ways to do this are:

a. Use a rubber with a specific Tg such that it is closer to room or ambient temperature and thus have a partial liquid component.
b. Using a rubber with a different copolymer content (e.g., Styrene: Butadiene in SBR rubber) which leads to a POD that has more of the low Tg component. Possible mixtures could include styrene at 15-80% and or butadiene at 10-85% or even blends of such rubbers. Natural rubber mixed with high styrene rubber or butyl rubber could work as well.
c. Using a different type of SBR with different ratios of cis and trans-1,4:1,2-vinyl content in the polybutadiene segments. Thus if the modified rubber has a higher hysteresis it will heat up quicker and make the rubber soften upon usage. On embodiment would be SBR with 10-82% vinyl content. Blending of standard and high hysteretic rubbers is also envisioned.
d. Use of a higher hysteresis fillers that will have the same effect as in C. An example would be a highly reinforcing carbon black like N220 instead of a non-reinforcing grade like N550. Filler could also be phenolic reinforcing resins, hydrocarbon resins, coumarone indene resins, silica (fumed and precipitated), clays, talcs, CaCO3, other elastomeric high Tg materials, TPEs, TPOs, TPUs other carbon or mineral based fillers.

The above approaches may be used to implement the embodiments shown in FIGS. 1, 2, 5-5*b*.

II. Impregnated Rubber

Manufacture a POD that will be impregnated with traction enhancing ingredients which will slowly leach to the surface. This could be accomplished by using a high boiling solvent that slowly brings the components to the surface or through blooming (vide infra) The above approaches may be used to implement the embodiments shown in FIGS. 1, 2, 5-5*b*, 12-14.

III. Pills or Inserts

Manufacture a POD that will contain a "pill" or insert that will leak a grip enhancing material. The POD will then allow the chemical to leach to the surface.

a. The "pill" or insert could be an absorbent material such as a sponge or foam that has a controlled, impact-driven release of the active ingredients.
   i. These ingredients could be liquid equivalents such that a solvent is not necessary. For example, there are hydrocarbon tackifiers available with a Tg of −36 C and acrylic PSA adhesives that are liquid at slightly elevated (35 C) temperatures.
   ii. The liquid ingredients could be present at the time the foam pill is manufactured so that they are completely and evenly dispersed in the pill.
   iii. The foam or sponge could be made from foamed elastomers, foamed polymeric materials e.g., polyurethanes.
b. The insert could be a cross linked rubber that has a controlled, impact-driven release of the active ingredients.
   i. These ingredients could again be liquid equivalents such that a solvent is not necessary.
   ii. The liquid ingredients could be present at the time the rubber is cured so that they are completely and evenly dispersed in the pill.
   iii. Any elastomeric material that will hold the ingredients in an appropriate manner could be used.

The above approaches may be used to implement the embodiments shown in FIGS. 6-11.

IV. Encapsulated Active Ingredients

Manufacture a POD that has encapsulated grip material that is released over time based on shear forces exerted on the shoe soles.

a. Employ microcapsules which contain liquid or solid active ingredients.
b. The force required to break the microcapsules can be controlled through the manufacturing specifications of the microcapsules. That is, by properly choosing the type of wall material employed, the thickness of the wall, and the size of the microcapsules one can tailor the breaking stress for the application.
c. The microcapsules can be added as dry ingredients and incorporated into a foam or rubber insert during curing.
d. The microcapsules could be added as a dispersion to an emulsion rubber latex and co-coagulated to be incorporated.

The above approaches may be used to implement the embodiments shown in FIGS. 1, 2, 5-14.

V. "Blooming" Active Ingredients

Manufacture a POD that has grip materials that will (bloom) migrate or leach to the surface.

a. Due to a mismatch in solubility, mobile polar materials can migrate to the surface of non-polar elastomers. (vice versa is possible) In this case the acrylic adhesive is of a higher polarity than the rubber. Further, certain tackifiers (e.g., phenolics) can be made very polar so they too will have a large mismatch with the rubber. Thus if chosen correctly both could migrate to the surface and become self-replenishing.
b. It is not necessary, however, to have all ingredients bloom. It could be that one or more components (e.g., the tackifier) is/are inherently compatible and used at a level that makes it effective throughout the bulk of the POD. Then at least one component migrates to refresh the surface of the POD. As wear occurs the other component/s will be newly available.
c. It is further known that certain agents (e.g., paraffin and polyethylene waxes, rosin acids and esters, phenolic resins) can increase the rate at which polar active ingredients migrate to the exterior surface of a tire. This technology is in almost every single exterior tire part formula. Thus it may be possible to use standard ingredients with a co-agent that enables them to bloom.

d. This effect is very dependent on the type of rubber employed. Thus certain rubbers (e.g., butyl rubber) are more likely to demonstrate blooming than others.

The above approaches may be used to implement the embodiments shown in FIGS. 1, 2, 5-5*b*, 12-14.

VI. Color Indicating PODS a. The use of dye-containing microcapsules in an exposed POD is envisioned so that the POD can be self-indicating for usage. For example, in a natural or white POD dye-containing microcapsules can be imbedded which release color upon shear. Once the POD has worn beyond a useful thickness the microcapsules would no longer be broken and the color would fade indicating it was time to be replaced.

b. A second approach to this is to use leukodyes in the microcapsules which are colorless but which become active upon exposure to developers. The developer can be present in the rubber to give the same effect as in a. Examples of developers are well known in the carbonless copy paper industry and include acids, organometallic acid salts such as zinc stearate, zinc salicylate, etc., organometallic salts of phenols can also work.

The above approaches may be used to implement the embodiments shown in FIGS. 5, 5*a*, 12, 14.

VII. High Wear PODS a. Use of a filler that will give good traction but have high wear characteristics so that it will refresh the surface more often and improve the grip. One example of this type of filler would be silica. The filler could also be carbon black, phenolic reinforcing resins, hydrocarbon resins, coumarone indene resins, silica (fumed and precipitated), clays, talcs, CaCO3, other elastomeric high Tg materials, TPEs, TPOs, TPUs other carbon or mineral based fillers.

The above approaches may be used to implement the embodiments shown in FIGS. 1, 2, 5-14.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A shoe sole for enhancing gripping with a smooth hard surface comprising:

a layer of material having a lower surface for contacting a smooth hard surface, said layer of material exhibiting a predetermined initial traction at said lower surface, and supply means for increasing traction at at least selected portions of said lower surface even after extended use by supplying, emitting, releasing or discharging a renewable coating of tackiness-enhancing substance onto said lower surface during use.

2. A shoe sole as defined in claim 1, wherein said material has a glass transition temperature $T_g$ selected to nearly correspond to the actual or ambient temperature $T_s$ of the shoe sole during play on said smooth hard surface such that $T_g-T_s\approx 0$-20° C.

3. A shoe sole as defined in claim 1, wherein said material is a copolymer having two distinct $T_g$'s one for each part of the copolymer composition with at least one $T_g$ satisfying the relationship $T_g-T_s\approx 0$-20° C.

4. A shoe sole as defined in claim 1, wherein said material is a synthetic rubber copolymer comprising styrene and butadiene.

5. A shoe sole as defined in claim 1, wherein said material is a rubber having a sufficiently high hysteresis to cause the rubber to heat up during use and increase the traction of the material upon usage.

6. A shoe sole as defined in claim 1, wherein said material has a sufficiently high hysteresis filler to cause the sole to heat up during use increase the traction of the material upon usage.

7. A shoe sole as defined in claim 1, wherein said supply comprises microcapsules dispersed in at least selected portions of said shoe sole.

8. A shoe sole as defined in claim 6, wherein said filler is selected from a group consisting of phenolic reinforcing resins, hydrocarbon resins, coumarone indene resins, silica (fumed and precipitated), clays, talcs, CaCO3, other elastomeric high Tg materials, TPEs, TPOs, TPUs and other carbon or mineral based fillers.

9. A shoe sole as defined in claim 1, wherein said material is impregnated with a tackiness-producing material.

10. A shoe sole as defined in claim 1, which includes a substance to cause said tackiness-enhancing substance to leach to said lower surface.

11. A shoe sole as defined in claim 10, wherein said leaching inducing substance comprises a high boiling point solvent.

12. A shoe sole as defined in claim 10, wherein said material includes a component selected to bloom and migrate the tackiness-enhancing material to said lower surface.

13. A shoe sole as defined in claim 1, wherein said traction enhancing means dispenses the tackiness-enhancing material onto said lower surface in response to application of forces to said shoe sole.

14. A shoe sole as defined in claim 1, wherein said tackiness-enhancing material comprises an adhesive;

and a tackifier.

15. A shoe sole as defined in claim 13, wherein said tackiness-enhancing material is released upon controlled impact to the shoe sole.

16. A shoe sole as defined in claim 13, wherein said tackiness-enhancing material is a solvent-free tackifier with a $T_g\approx T_a$ where $T_a$ is an ambient temperature.

17. A shoe sole for enhancing gripping with a smooth hard surface comprising:

a layer of material having a lower surface for contacting a smooth hard surface, said material exhibiting a predetermined traction at said lower surface in relation to the smooth hard surface, and a plurality of removable and replaceable pods projecting below said lower surface and formed of a material having traction greater than said predetermined traction, whereby the overall traction of said shoe sole is enhanced, said pods including an outer wall or cover and a reservoir of tackiness-enhancing material, said outer wall or cover including means for dispensing tackiness-enhancing material from said reservoir through said outer wall or cover to supply, emit, release or discharge a renewable coating of tackiness-enhancing substance onto said lower surface during use.

18. A shoe sole as defined in claim 17, wherein said plurality of pods comprise replaceable pods infused with grip enhancing material that can be released, emitted or discharged onto outer surfaces of said pods.

19. A shoe sole as defined in claim 17, wherein said pods include microcapsules containing said tackiness-enhancing material, said microcapsules having wall properties selected to rupture in responses to shear forces applied to the shoe soles.

20. A shoe sole as defined in claim 17, wherein said pods include dye containing microcapsules for dispensing tackiness-enhancing material, whereby said pods maintain a predetermined color of said dye until said microcapsules are depleted of tackiness-enhancing material resulting in a change of color indicating that said pods need to be replaced or replenished.

21. A shoe sole as defined in claim 17, wherein said pods are movably secured to the shoe sole.

22. A shoe sole as defined in claim 17, wherein said material has a glass transition temperature $T_g$ selected to nearly correspond to the actual temperature $T_s$ of the said pod during play on said smooth hard surface such that $T_g - T_s \approx 0\text{-}20°$ C.

23. A shoe sole as defined in claim 17, wherein said material includes a component selected to bloom and migrate the tackiness-enhancing material to said lower surface.

* * * * *